United States Patent [19]

Szczupak

[11] Patent Number: 4,557,665

[45] Date of Patent: Dec. 10, 1985

[54] VARIABLE INLET AREA TURBINE

[75] Inventor: David T. Szczupak, Kirkheaton, England

[73] Assignee: Helset Engineering Company Limited, Huddersfield, England

[21] Appl. No.: 499,734

[22] Filed: May 31, 1983

[30] Foreign Application Priority Data

May 28, 1982 [GB] United Kingdom ..... 8215735

[51] Int. Cl.[4] ..... F01D 17/14; F02B 37/12

[52] U.S. Cl. ..... 415/158; 60/602

[58] Field of Search ..... 415/47–49, 415/150, 158, 157, 164, 165, 146, 147; 60/602, 615

[56] References Cited

U.S. PATENT DOCUMENTS

| | | | |
|---|---|---|---|
| 2,846,185 | 8/1958 | Widmer | 415/150 |
| 3,195,805 | 7/1965 | Cholvin et al. | 60/602 X |
| 3,478,955 | 11/1969 | Kunderman | 415/150 |
| 3,975,911 | 8/1976 | Morgulis et al. | 415/146 X |
| 4,005,579 | 2/1977 | Lloyd | 60/602 |
| 4,214,850 | 7/1980 | Sato | 415/49 |
| 4,403,538 | 9/1983 | Rise | 60/602 X |
| 4,403,914 | 9/1983 | Rogo et al. | 415/165 |

FOREIGN PATENT DOCUMENTS

| | | | |
|---|---|---|---|
| 34915 | 8/1981 | European Pat. Off. | 415/158 |

*Primary Examiner*—Abraham Hershkovitz
*Assistant Examiner*—Joseph M. Pitko
*Attorney, Agent, or Firm*—Gary M. Gron; Robert T. Ruff

[57] ABSTRACT

A turbocharger for an internal combustion engine wherein a turbine wheel 18 in chamber 47 is driven by the engine's exhaust gases supplied to inlet volute 44 introducing the gases to the chamber through radially extending annular inlet passage 45 containing stationary vanes 60. The inlet passage 45 containing stationary vanes 60. The inlet area of passage 45 is selectively variable by moving axially a regulating ring part 61 (slotted at 70 to receive the vanes) relative to wall 46 of the passage. The ring part 61 is part of a thin walled regulating element 62 additionally comprising concentric tubular flanges 64,67. Flange 67 is in sliding contact with a stationary sealing ring 71 which prevents exhaust gases which may have entered region 122 behind the ring part 61 from passing under that ring part to the chamber 47. Thus pressure builds up in region 122 compelling gases from the volute to pass between the ring part 61 and wall 46, consequently the gases driving the turbine are substantially prevented from bypassing the regulated inlet passage 45.

7 Claims, 4 Drawing Figures

VARIABLE INLET AREA TURBINE

This invention relates to a variable inlet area turbine which may be used in turbochargers.

Turbochargers are used extensively in modern diesel engines to improve fuel economy and minimize noxious emissions. Such a turbocharger comprises a turbine wheel in a chamber within a turbine housing, a compressor wheel and housing, and a central cast bearing housing for journaling a shaft which connects the compressor and turbine wheels. The turbine wheel rotates when driven by exhaust gases from an internal combustion engine and causes the compressor wheel to rotate and compress air, for delivery to the engine, at a rate that is greater than the rate the engine can naturally aspirate. The turbocharger pressure output is a function of component efficiencies, mass flow through the turbine and compressor and the pressure drop across the turbine.

One problem that occurs with turbochargers is that acceleration of an engine from a relatively low rpm is accompanied by a noticeable lag in the pressure increase from the turbocharger resulting in a noticeable lag in acceleration. The reason for this is that the inlet area of the turbine is designed for maximum rated conditions. As a result at low engine rpm, the velocity of the gases passing across the turbine wheel is relatively low. This allows the turbocharger rpm to drop to such a low level that a substantial increase in gas velocity is required to increase the turbocharger rpm.

In order to overcome this deficiency, a number of schemes have been proposed to provide the turbocharger with a variable inlet area so that at low engine rpm the area may be made small to increase the velocity of the exhaust gases entering the turbine chamber and maintain the turbocharger at a sufficiently high rpm to minimize lag.

One of the proposals is a variable inlet area arrangement of the type in which a regulating ring arrangement extending generally radially in an annular inlet passage of the turbine is movable axially across the inlet to vary the axial dimensions thereof and thus increase or decrease the overall inlet area. The inlet passage may contain fixed turbine inlet vanes and the ring arrangement may have a series of through slots accommodating the fixed series of vanes to permit free movement of the ring arrangement. Some turbines have at least one vane which is disposed adjacent the tongue (i.e. the narrow closed end) of the inlet volute and is radially outwardly extended to meet the tip of the tongue to keep separate the inflows to the turbine chamber of the motive fluid on either side of the extended vane. If the ring arrangement is thin walled with a radially outer part comprising a cylindrical flange about the turbine axis, the slot accommodating the extended vane is axially extended through the cylindrical wall to accommodate a radially outermost part of the tongue vane when the ring arrangement is moved axially.

In proposals of the aforesaid type the flow of exhaust gas to the turbine chamber of a turbocharger through the inlet is intended to be substantially confined to a route between a first side of the ring arrangement and a side wall of the inlet. But unless the ring arrangement is manufactured to very close tolerances, some portion of the exhaust gas may depart from the desired route by flowing around the radially outermost part of the ring arrangement and through gaps between any through slots in the ring arrangement and inlet vanes in the slots (and through part of any axially extended slot disposed axially beyond the tongue vane). As a result, that portion of the gas passes to the opposite or second side of the ring arrangement remote from the said side wall. From that second side the gases can follow a generally radially inward path past the radially innermost edge of the ring arrangement and enter the turbine chamber, thus bypassing the desired route. As a result the overall velocity of the exhaust gases entering the turbine chamber is not as high as is desired and the benefit of a variable area inlet is not fully realized.

The above problems are solved by a variable inlet area turbine comprising a turbine housing and a radial inward flow turbine wheel mounted for rotation in a chamber within the housing, the chamber having an annular inlet passage between a side wall and a first side of a regulating ring arrangement being remote from said wall. A means is provided for displacing the ring arrangement axially relatively to the side wall so as to vary the flow area of the passage, and a substantially fluid tight annular sealing arrangement extends around the axis of the passage and is disposed between the ring arrangement and the chamber to obstruct flow of fluid to the chamber from the second side of the ring arrangement.

The above and other related features of the present invention will be apparent from a reading of the following description of the disclosure found in the accompanying drawings and the novelty thereof pointed out in the appended claims.

Figure 1:
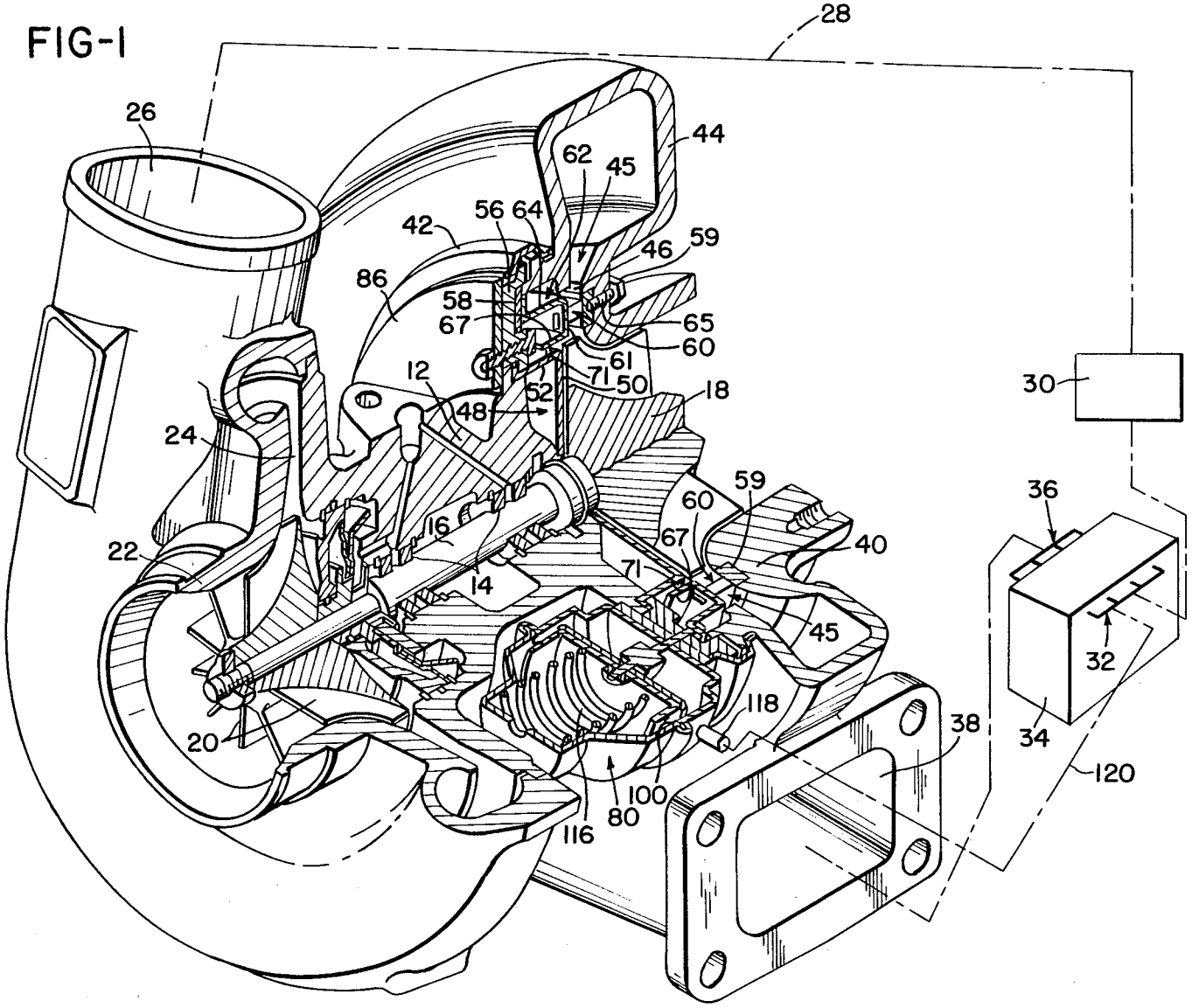
FIG. 1 is a simplified perspective view of a turbocharger which incorporates a variable inlet area turbine formed according to the invention, in which the area of the inlet passage is shown of maximum size.

In the drawings and following description like references refer to like or comparable parts.

Figure 2:
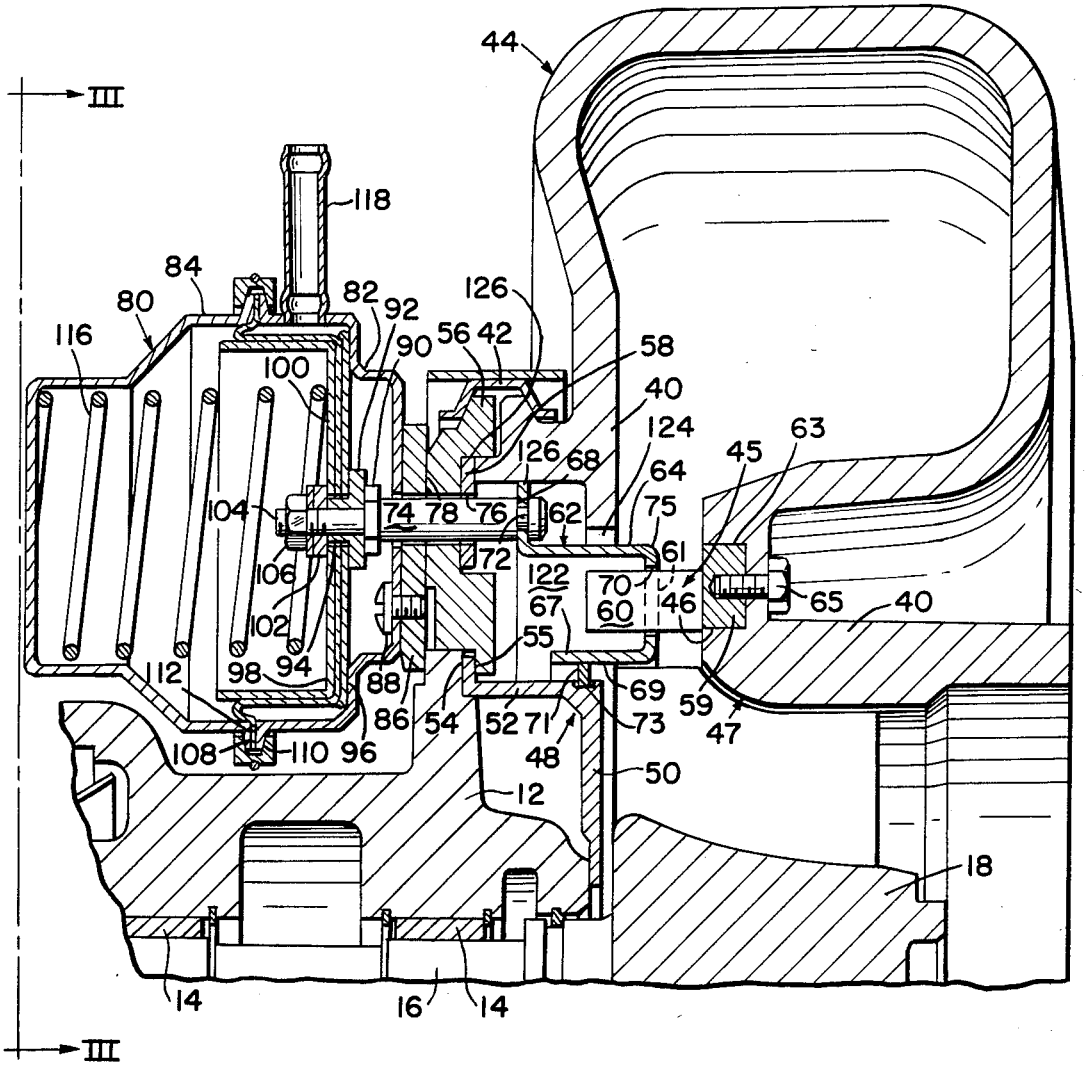
FIG. 2 is a fragmentary, longitudinal section view on an enlarged scale of the turbocharger illustrated in FIG. 1, in which the inlet passage is shown of minimum size.

The turbocharger in FIGS. 1 and 2 comprises a central cast bearing housing 12 having a pair of sleeve bearings 14 for supporting a shaft 16 that is attached to a radial inward flow turbine wheel 18. The turbine wheel 18 drives the shaft 16 which is in turn connected to a centrifugal compressor 20, contained within a compressor housing 22. Rotation of the compressor 20 accelerates air which is discharged into a annular diffuser 24 and then to a scroll-like outlet 26 for converting the velocity head into a static pressure head. Pressurized air is directed from the outlet 26, through an appropriate conduit 28, past an aftercooler 30 if desired, and then to an intake manifold 32 of a reciprocating internal combustion engine 34. The internal combustion engine utilizes the compressed air to form a combustible mixture which is ignited by a spark or the heat of combustion to drive the engine. The products of combustion are fed through an exhaust manifold 36 to an inlet 38 of an inlet volute 44 of a turbine housing 40 which is secured to the bearing housing 12 by a clamp band 42. The inlet volute 44 is of gradually decreasing area and feeds an annular inlet passage 45 defined between a radially extending wall 46 and a radially extending regulating ring part 61 of an area control element 62. The axis of passage 45 substantially coincides with that of the turbine wheel 18. The wall 46 may be integral, at least in part, with the turbine housing 40. The inlet passage 45 leads into a turbine chamber 47 containing the turbine wheel 18 within the housing 40. A side of the turbine chamber is formed by a wall component 48 comprising a thin wall cylinder or tube 52, a radially inwardly directed flange 50 and a radially outwardly extending flange 54. The flange 54 in annular recess 55 is clamped between the bearing housing 12 and an annular plate 56. In clamping the plate 56 to the turbine housing 40 the clamp band 42 also clamps spacing ring 58. A series of vanes 60 extending across the inlet 45 are fixed to a ring 59 in annular recess 63 in turbine housing 40 to which the ring 59 is clamped by bolts, only one shown at 65. As shown the ring 59 can also provide part of the wall 56. The vanes 60 are orientated so that they direct incoming gas flow in a tangential direction to provide the appropriate gas flow.

As shown in FIG. 2, a variable area control mechanism incorporated in the turbocharger includes the area control element 62 which is a thin walled member comprising an annular thin wall tubular part 64 having the integral, radially inwardly directed thin wall ring part 61 and an integral, radially outwardly directed flange 68.

The element 62 may be formed by stamping or pressing and may be of stainless steel. A tubular cylindrical flange 67 integral with the radially innermost side of the ring 61 is directed away from the wall 46 and has an inner substantially cylindrical surface 69 having an axis which substantially coincides with the axis of the annular inlet 45. Surface 69 is in substantially fluid-tight sliding contact with a metal sealing ring 71 mounted against axial displacement in a recess 73 in the outer side of tube 52 of the wall component 48.

In a preferred embodiment, the thickness of the ring part 61 does not exceed about six percent of the outer diameter of the ring shaped array of the vanes 60. The junction of the ring part 61 with the cylinder 64 is rounded at 75 and has a plurality of slots 70 which accept the vanes 60 to permit axial sliding movement of ring part 61 relatively to the side wall 46. Flange 68 has a plurality of holes 72 each of which receives a shaft 74 extending through a hole 76 in the ring 58. As illustrated in FIG. 2, the hole 72 is a keyhole slot to receive and affix shaft 74 to flange 68. The shaft 74 also extends through hole 78, plate 56, actuator mounting plate 86, and an actuator housing element 82. Housing element 82 is fixed to the actuator mounting plate 86 by screws 88. Plate 86 is in turn connected to back plate 56 by a plurality of fasteners, not shown. Shaft 74 connects with an actuator module 80 comprising an annular housing element 84 connected to element 82. Shaft 74 has an integral shoulder 90 which provides a stop for an insulating bushing 92. Bushing 92 has a boss 94 to pilot a flexible rolling diaphragm 100 sandwiched between a disc 96 and cup 98. Another insulating bushing 102 is received over the threaded end 104 of shaft 74, and a nut 106 clamps the diaphragm and associated elements between bushing 102 and flange 90. The outer periphery 108 of the rolling diaphragm 100 is clamped between flanges 110 and 112 of housing elements 82 and 84, respectively. A spring 116 acts against the interior of housing 84 to push diaphragm 100 and, in turn, shaft 74 towards the right as viewed in FIG. 2. The interior of housing element 82 receives an air pressure control signal through an inlet fitting II8. As illustrated in FIG. 1, fitting 118 can be connected to the inlet manifold 32 of the engine 34 through a conduit 120.

Figure 3:
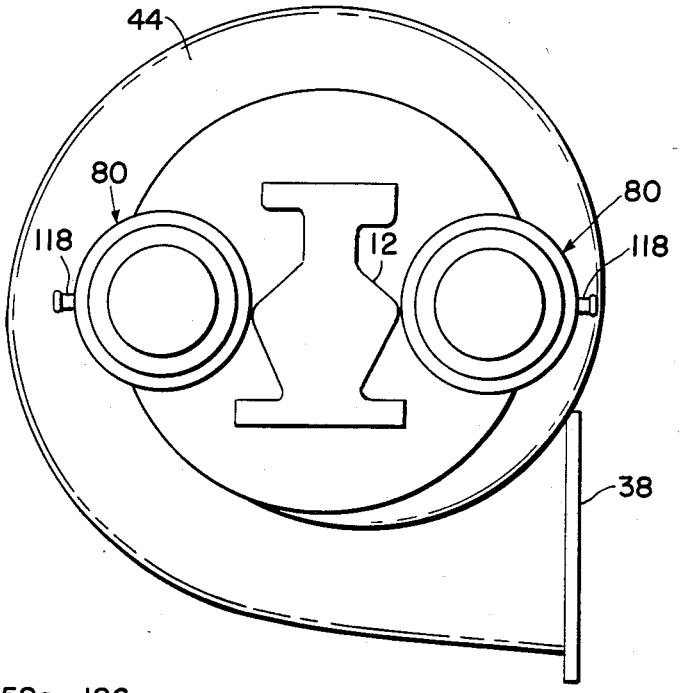
FIG. 3 is a diagrammatic cross-sectional view on line III—III in FIG. 2.

As shown in FIG. 3, actuator modules 80 are positioned to the side of the bearing housing 12. Preferably, there are two modules (only one is shown in FIG. 1) secured to points located 180° from each other and disposed around flange 68.

During operation the turbine wheel 18 is rotated by the passage of exhaust gases from engine exhaust manifold 36. Rotation of turbine wheel 18 causes compressor 20 to rotate and pressurize air for delivery to the intake manifold 32 of the engine 34. The spring 116 pushes the area control element 62 towards a position of minimum flow area. When the element 62 is in this position, the cylindrical part 64 is a barrier to flow and the ring part 61 acts as one wall of the inlet passage.

Although some of the exhaust gases from inlet 45 can enter region 122 (FIG. 2) at a rear side of the ring part 61 remote from the wall 46 by flowing between the vanes 60 and sides of slots 70 and through clearances at 124 and 126 between the turbine housing 40 on the one hand and the cylindrical part 64 and the flange 68 on the other hand, the gases in region 122 are prevented by sealing ring 71 from entering the turbine chamber 47. In consequence there is a relatively fast build up of static pressure in region 122, which substantially prevents more exhaust gas from entering the region 122. Consequently the gases must flow between the ring part 61 and the opposed wall 46 of the turbine housing. This causes the gas flow to accelerate and achieve a higher entry velocity around the turbine wheel 18. The increase in velocity causes an increase in turbine rpm to increase the air pressure in intake manifold 32. Conduit 120 senses the pressure in the intake manifold 32 and applies it across the right face of the flexible diaphragm 100 in opposition to the force of the spring 116. When the manifold pressure starts to exceed a given level selected by the strength of the spring 116, the air pressure inside housing 82 pushes the flexible diaphragm 100 thereby displacing the area control element 62 to a more open position. This in turn increases the flow area and reduces the velocity of the gases entering the turbine. Thus the variable area control mechanism varies the velocity entering the turbine to achieve a controlled pressure level at the intake manifold 32.

Figure 4:
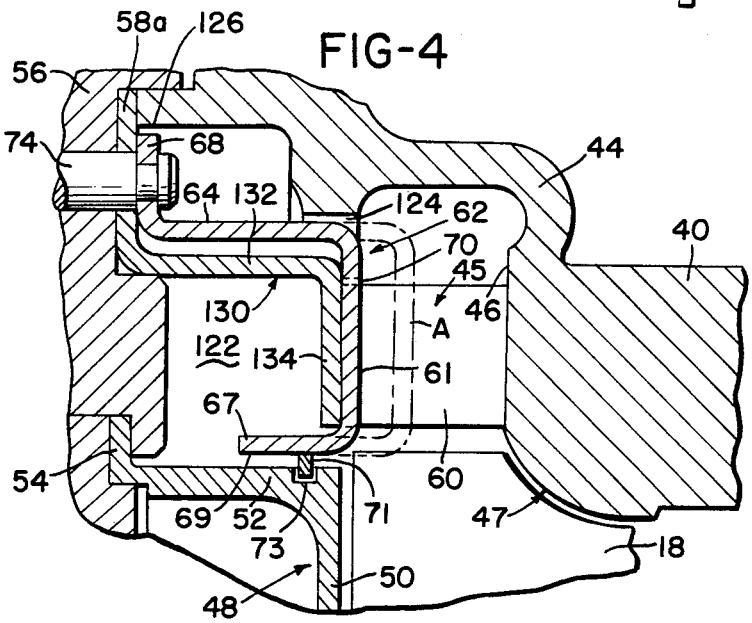
FIG. 4 is a longitudinal section of a fragment of a modification of the turbocharger in FIG. 1, in which the inlet passage is shown when its size is a maximum.

In the modification in FIG. 4, the inlet vanes 60 are mounted on an annular support 130 behind the control element 62. The support 130 comprises a cylindrical part 132 with an integral inwardly directed flange 134 bearing the vanes 60. The cylindrical part 132 is also integral with an outwardly directed flange 58*a* clamped between the turbine housing 40 and the plate 56. The flange 134 is substantially co-planar with the flange 50 of the wall component 48. The dotted line position shown at A of the element 62 shows the position corresponding to minimum area of the inlet 45.

While a preferred embodiment of the present invention has been described, it should be apparent to those skilled in the art that it may be practiced in other forms without departing from the spirit and scope thereof.

Having thus described the invention, what is novel and desired to be secured by Letter Patent of the United States is:

1. A variable inlet area turbine comprising a turbine housing, a radial inward flow turbine wheel mounted for rotation in a chamber within the housing, said chamber having an annular inlet passage defined by a side wall and an opposed spaced annular opening defined around its inner diameter by an annular wall arrangement through which a first side of a thin wall regulating ring pressing extends, said regulating ring pressing comprising inner and outer thin walled elongated tubular portions interconnected by a thin walled ring part and an integral radially outwardly directed thin wall flange connected to the outer tubular portion thereby permitting compliance of said regulating ring pressing, an opposite or second side of the ring arrangement being remote from said side wall, means including at least two actuating shafts connected to and acting on said integral outwardly directed thin wall flange for displacing the regulating ring means axially relatively to the side wall so as to vary the flow area of the inlet passage, and means forming a substantially fluid tight annular floating sealing ring received in an outwardly facing annular groove in said turbine housing annular wall arrangement and extending only between the inner turbular portion of said regulating ring and the turbine housing annular wall arrangement, said sealing ring having an outer circumferential surface in sliding contact with an inner surface of the inner tubular portion to obstruct flow of fluid to the chamber from the annular opening.

2. Apparatus as in claim 1, in which the regulating ring means has through slots and said apparatus further comprises fixed inlet vanes disposed in the inlet passage.

3. Apparatus as in claim 1 in which each said actuating shaft extends through an opening in the turbine housing, and actuator means being provided for displacing the shafts.

4. Apparatus as in claim 3, in which a compressor is positioned adjacent the turbine, and the actuator means is positioned between the turbine housing and the compressor.

5. Apparatus as in claim 3, in which a pair of actuator means are connected to the regulating ring arrangement at locations spaced substantially 180° from one another, about the axis of rotation of the turbine wheel.

6. Apparatus as in claim 3, in which the regulating ring arrangement is biased towards said side wall and moves away from the side wall in response to the displacement of the actuating shafts.

7. Apparatus as in claim 3, in which the actuator means comprises diaphragm assemblies each having a periphery fixed in the actuator means, each diaphragm assembly having a central portion which is movable in response to a pressure signal, said central portion having a hole, a said actuating shaft extending through the hole, and an insulating bushing extending through the hole and positioned over that actuating shaft to secure the diaphragm assembly to that actuating shaft.

* * * * *